US009952526B2

(12) United States Patent
Omura et al.

(10) Patent No.: US 9,952,526 B2
(45) Date of Patent: Apr. 24, 2018

(54) IMAGE FORMING APPARATUS FOR ADJUSTING POSITION OF IMAGE FORMED ON SHEET

(71) Applicant: CANON KABUSHIKI KAISHA, Tokyo (JP)

(72) Inventors: Naoka Omura, Matsudo (JP); Kunio Takane, Urayasu (JP); Noriaki Matsui, Kashiwa (JP); Takuya Hayakawa, Koshigaya (JP); Kiyoharu Kakomura, Nagareyama (JP); Takayuki Inoue, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/234,885

(22) Filed: Aug. 11, 2016

(65) Prior Publication Data

US 2017/0052468 A1 Feb. 23, 2017

(30) Foreign Application Priority Data

Aug. 17, 2015 (JP) ..... 2015-160556

(51) Int. Cl.
*G03G 15/00* (2006.01)
*G03G 15/01* (2006.01)

(52) U.S. Cl.
CPC ..... *G03G 15/0131* (2013.01); *G03G 15/5058* (2013.01); *G03G 2215/0158* (2013.01)

(58) Field of Classification Search
CPC ..... G03G 15/5058; G03G 15/0131; G03G 15/0189; G03G 15/5054; G03G 2215/0129; G03G 2215/0158; G03G 2215/0161
See application file for complete search history.

(56) References Cited

U.S. PATENT DOCUMENTS 9,310,744 B1 * 4/2016 Watanabe ..... G03G 15/0189
2008/0279599 A1 * 11/2008 Nagatsuka ..... G03G 15/0131 399/301
2009/0122360 A1 * 5/2009 Tanaka ..... G03G 15/0131 358/474

(Continued)

FOREIGN PATENT DOCUMENTS

JP 2003-173109 A 6/2003

*Primary Examiner* — Clayton E Laballe
*Assistant Examiner* — Ruifeng Pu
(74) *Attorney, Agent, or Firm* — Canon U.S.A., Inc. IP Division

(57) ABSTRACT

An image forming apparatus includes a first image forming unit configured to form a first image in a chromatic color, a second image forming unit configured to form a second image in black, an intermediate transfer member, a sensor, a first adjustment unit configured to adjust the image forming position for the black based on an adjustment value, a second adjustment unit configured to adjust image forming position based on an adjustment condition, and a generation unit configured to generate the adjustment condition. The generation unit generates a first adjustment condition based on a user instruction relating to a first test image having chromatic color on a sheet input from the input unit. The generation unit generates a second adjustment condition based on the reading result of the second test image having black on a sheet from a reading device.

8 Claims, 15 Drawing Sheets

(56) References Cited

U.S. PATENT DOCUMENTS

| | | | | |
|---|---|---|---|---|
| 2009/0154944 | A1* | 6/2009 | Kawaguchi | G03G 15/5062 399/49 |
| 2011/0026979 | A1* | 2/2011 | Murayama | G03G 15/0131 399/301 |
| 2011/0097095 | A1* | 4/2011 | Shirakata | G03G 15/0131 399/49 |
| 2012/0163844 | A1* | 6/2012 | Murayama | G03G 15/0194 399/49 |
| 2013/0164048 | A1* | 6/2013 | Otsuka | G03G 15/0173 399/301 |
| 2013/0200126 | A1* | 8/2013 | Kokomoto | B65G 43/00 226/1 |
| 2013/0287457 | A1* | 10/2013 | Sato | G03G 15/50 399/301 |
| 2014/0169843 | A1* | 6/2014 | Igarashi | G03G 15/5058 399/301 |
| 2015/0023702 | A1* | 1/2015 | Cho | G03G 15/5058 399/301 |
| 2015/0338809 | A1* | 11/2015 | Omura | G03G 15/0131 399/301 |
| 2016/0091850 | A1* | 3/2016 | Noda | G03G 15/5054 399/301 |

* cited by examiner

FIG.4

400

| 411 SHEET NAME | 412 SHEET LENGTH IN SUB-SCANNING DIRECTION (mm) | 413 SHEET LENGTH IN MAIN SCANNING DIRECTION (mm) | 414 GRAMMAGE (g/m²) | 415 SURFACE PROPERTY | 416 COLOR | 417 PREPRINTED PAPER | 420 DEVIATION AMOUNT OF PRINTING POSITION (ON FRONT SURFACE) | 421 DEVIATION AMOUNT OF PRINTING POSITION (ON REAR SURFACE) |
|---|---|---|---|---|---|---|---|---|
| ABC-MADE RECYCLED PAPER 1 | 210 | 297 | 75 | PLAIN PAPER | WHITE | NO | READING POSITION: 0.3 mm<br>SIDE POSITION: -0.1 mm<br>MAIN SCANNING MAGNIFICATION: +0.02%<br>SUB-SCANNING MAGNIFICATION: +0.01% | READING POSITION: 0.2 mm<br>SIDE POSITION: 0.1 mm<br>MAIN SCANNING MAGNIFICATION: +0.02%<br>SUB-SCANNING MAGNIFICATION: -0.03% |
| ABC-MADE RECYCLED PAPER 2 | 297 | 420 | 75 | PLAIN PAPER | WHITE | NO | READING POSITION: 0.0 mm<br>SIDE POSITION: -0.0 mm<br>MAIN SCANNING MAGNIFICATION: +0.00%<br>SUB-SCANNING MAGNIFICATION: +0.00% | READING POSITION: 0.0 mm<br>SIDE POSITION: -0.0 mm<br>MAIN SCANNING MAGNIFICATION: +0.00%<br>SUB-SCANNING MAGNIFICATION: +0.00% |
| DEF-MADE EMBOSSED PAPER A-1 | 216 | 279 | 150 | EMBOSSED | WHITE | NO | READING POSITION: 0.5 mm<br>SIDE POSITION: -0.5 mm<br>MAIN SCANNING MAGNIFICATION: +0.02%<br>SUB-SCANNING MAGNIFICATION: +0.02% | READING POSITION: -0.3 mm<br>SIDE POSITION: 0.5 mm<br>MAIN SCANNING MAGNIFICATION: +0.01%<br>SUB-SCANNING MAGNIFICATION: -0.03% |
| DEF-MADE COATED PAPER P-1 | 279 | 432 | 128 | TWO-SIDED COATED | WHITE | NO | READING POSITION: 0.4 mm<br>SIDE POSITION: -0.2 mm<br>MAIN SCANNING MAGNIFICATION: +0.12%<br>SUB-SCANNING MAGNIFICATION: +0.08% | READING POSITION: -0.2 mm<br>SIDE POSITION: 0.6 mm<br>MAIN SCANNING MAGNIFICATION: -0.02%<br>SUB-SCANNING MAGNIFICATION: -0.01% |
| XYZ-MADE COLORED PAPER 81 | 210 | 297 | 75 | PLAIN PAPER | ORANGE | NO | READING POSITION: 0.0 mm<br>SIDE POSITION: -0.0 mm<br>MAIN SCANNING MAGNIFICATION: +0.00%<br>SUB-SCANNING MAGNIFICATION: +0.00% | READING POSITION: 0.0 mm<br>SIDE POSITION: -0.0 mm<br>MAIN SCANNING MAGNIFICATION: +0.00%<br>SUB-SCANNING MAGNIFICATION: +0.00% |
| XYZ-MADE COLORED PAPER 82 | 210 | 297 | 75 | PLAIN PAPER | PINK | NO | READING POSITION: 0.0 mm<br>SIDE POSITION: -0.0 mm<br>MAIN SCANNING MAGNIFICATION: +0.00%<br>SUB-SCANNING MAGNIFICATION: +0.00% | READING POSITION: 0.0 mm<br>SIDE POSITION: -0.0 mm<br>MAIN SCANNING MAGNIFICATION: +0.00%<br>SUB-SCANNING MAGNIFICATION: +0.00% |
| FGH-MADE GRAPH PAPER 75 | 210 | 297 | 75 | PLAIN PAPER | WHITE | YES | READING POSITION: 0.0 mm<br>SIDE POSITION: -0.0 mm<br>MAIN SCANNING MAGNIFICATION: +0.00%<br>SUB-SCANNING MAGNIFICATION: +0.00% | READING POSITION: 0.0 mm<br>SIDE POSITION: -0.0 mm<br>MAIN SCANNING MAGNIFICATION: +0.00%<br>SUB-SCANNING MAGNIFICATION: +0.00% |
| FGH-MADE PLAIN PAPER 2 | 210 | 297 | 75 | PLAIN PAPER | WHITE | NO | READING POSITION: -0.03 mm<br>SIDE POSITION: -0.07 mm<br>MAIN SCANNING MAGNIFICATION: +0.06%<br>SUB-SCANNING MAGNIFICATION: -0.01% | READING POSITION: -0.03 mm<br>SIDE POSITION: -0.10 mm<br>MAIN SCANNING MAGNIFICATION: +0.04%<br>SUB-SCANNING MAGNIFICATION: +0.02% |

FIG.6

700

| | 710 MEASUREMENT VALUE | 711 IDEAL VALUE | 712 DEVIATION AMOUNT OF PRINTING POSITION |
|---|---|---|---|
| READING POSITION (FRONT SURFACE) | $\frac{(c)+(e)}{2}$ | 1 cm | MEASUREMENT VALUE - IDEAL VALUE |
| SIDE POSITION (FRONT SURFACE) | $\frac{(f)+(j)}{2}$ | 1 cm | MEASUREMENT VALUE - IDEAL VALUE |
| MAIN SCANNING MAGNIFICATION (FRONT SURFACE) | $\frac{((B)-(d)-(f))+((B)-(h)-(j))}{2}$ | (SHEET LENGTH IN MAIN SCANNING DIRECTION) - 2cm | $\frac{\text{(MEASUREMENT VALUE - IDEAL VALUE)}}{\text{IDEAL VALUE}}$ |
| SUB-SCANNING MAGNIFICATION (FRONT SURFACE) | $\frac{((A)-(c)-(g))+((A)-(e)-(i))}{2}$ | (SHEET LENGTH IN SUB-SCANNING DIRECTION) - 2cm | $\frac{\text{(MEASUREMENT VALUE - IDEAL VALUE)}}{\text{IDEAL VALUE}}$ |
| READING POSITION (REAR SURFACE) | $\frac{(k)+(m)}{2}$ | 1 cm | MEASUREMENT VALUE - IDEAL VALUE |
| SIDE POSITION (REAR SURFACE) | $\frac{(n)+(r)}{2}$ | 1 cm | MEASUREMENT VALUE - IDEAL VALUE |
| MAIN SCANNING MAGNIFICATION (REAR SURFACE) | $\frac{((B)-(l)-(n))+((B)-(p)-(r))}{2}$ | (SHEET LENGTH IN MAIN SCANNING DIRECTION) - 2cm | $\frac{\text{(MEASUREMENT VALUE - IDEAL VALUE)}}{\text{IDEAL VALUE}}$ |
| SUB-SCANNING MAGNIFICATION (REAR SURFACE) | $\frac{((A)-(k)-(o))+((A)-(m)-(q))}{2}$ | (SHEET LENGTH IN SUB-SCANNING DIRECTION) - 2cm | $\frac{\text{(MEASUREMENT VALUE - IDEAL VALUE)}}{\text{IDEAL VALUE}}$ |

FIG.9

900

| | 910 MEASUREMENT VALUE | 911 IDEAL VALUE | 912 DEVIATION AMOUNT OF PRINTING POSITION |
|---|---|---|---|
| READING POSITION (FRONT SURFACE) | $\frac{(AA) + (DD)}{2}$ | 1 cm | MEASUREMENT VALUE - IDEAL VALUE |
| SIDE POSITION (FRONT SURFACE) | $\frac{(FF) + (GG)}{2}$ | 1 cm | MEASUREMENT VALUE - IDEAL VALUE |
| MAIN SCANNING MAGNIFICATION (FRONT SURFACE) | (CC) | (SHEET LENGTH IN MAIN SCANNING DIRECTION) - 2cm | $\frac{\text{(MEASUREMENT VALUE - IDEAL VALUE)}}{\text{IDEAL VALUE}}$ |
| SUB-SCANNING MAGNIFICATION (FRONT SURFACE) | $\frac{(BB) + (EE)}{2}$ | (SHEET LENGTH IN SUB-SCANNING DIRECTION) - 2cm | $\frac{\text{(MEASUREMENT VALUE - IDEAL VALUE)}}{\text{IDEAL VALUE}}$ |
| READING POSITION (REAR SURFACE) | $\frac{(HH) + (KK)}{2}$ | 1 cm | MEASUREMENT VALUE - IDEAL VALUE |
| SIDE POSITION (REAR SURFACE) | $\frac{(MM) + (NN)}{2}$ | 1 cm | MEASUREMENT VALUE - IDEAL VALUE |
| MAIN SCANNING MAGNIFICATION (REAR SURFACE) | (JJ) | (SHEET LENGTH IN MAIN SCANNING DIRECTION) - 2cm | $\frac{\text{(MEASUREMENT VALUE - IDEAL VALUE)}}{\text{IDEAL VALUE}}$ |
| SUB-SCANNING MAGNIFICATION (REAR SURFACE) | $\frac{(II) + (LL)}{2}$ | (SHEET LENGTH IN SUB-SCANNING DIRECTION) - 2cm | $\frac{\text{(MEASUREMENT VALUE - IDEAL VALUE)}}{\text{IDEAL VALUE}}$ |

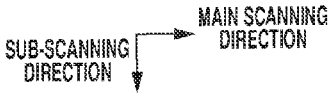
FIG.15A
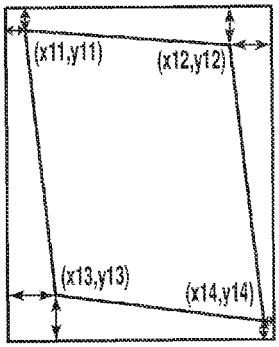
FIG.15B
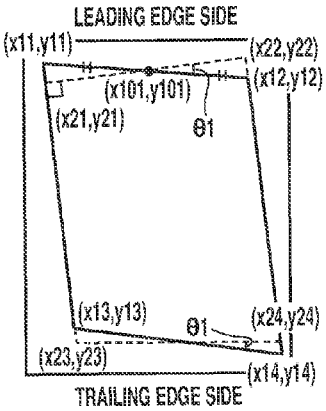
FIG.15C
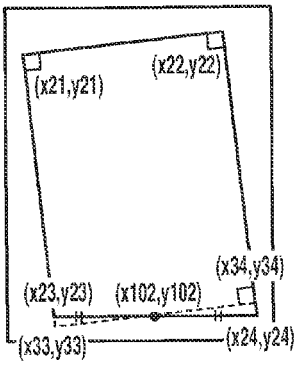
FIG.15D
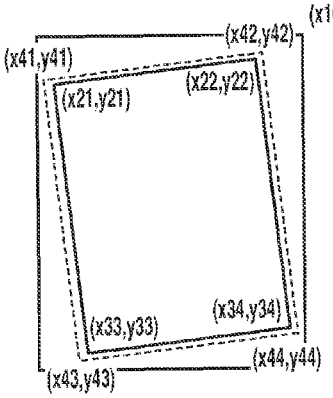
FIG.15E
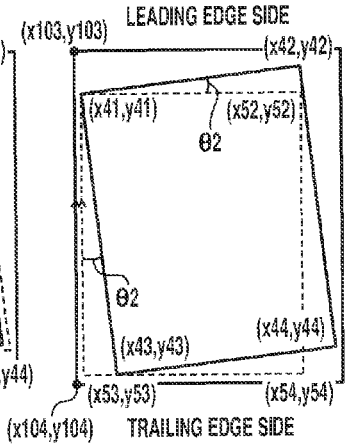
FIG.15F
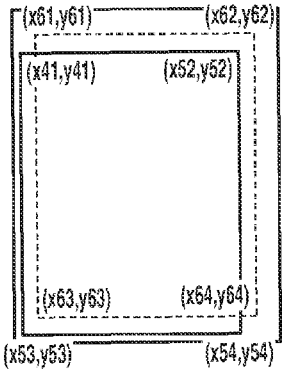
FIG.15G
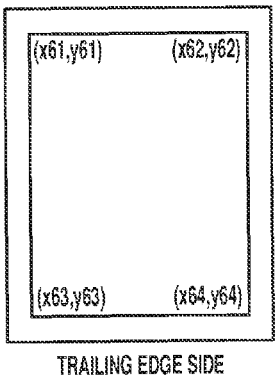

IMAGE FORMING APPARATUS FOR ADJUSTING POSITION OF IMAGE FORMED ON SHEET

BACKGROUND OF THE INVENTION

Field of the Invention

The present disclosure generally relates to image forming and, more particularly, to an image forming apparatus for adjusting a position of an image formed on a sheet.

Description of the Related Art

An electrophotographic image forming apparatus includes a photoreceptor, a charging device, an exposure device, a developing device, a transfer device, and a fixing device. The charging device charges the photoreceptor, and the exposure device exposes the charged photoreceptor using light based on image data to form an electrostatic latent image. The developing device develops the electrostatic latent image on the photoreceptor using toner, and forms an image on the photoreceptor. A sheet is fed and conveyed so that a timing at which the image on the photoreceptor is conveyed to a transfer position and a timing at which a sheet is conveyed to the transfer position become equal to each other. The transfer device transfers the image on the photoreceptor to the sheet at the transfer position. When the sheet to which the image has been transferred is conveyed to the fixing device, the fixing device applies heat and pressure to the image on the sheet, and fixes the image on the sheet.

If an image is printed on sheets on which a ruled line has been previously printed, for example, a printing position needs to be adjusted for each of the sheets to be used. This is because, when the sheets differ in the size, the grammage, and the quality of material, the image formed on the sheets may vary in the position, the magnification, and the inclination.

In order to adjust a printing position, a method has been known in which an image forming apparatus forms a reference image on a sheet, a user measures a distance from an edge of the sheet to the reference image, and corrects a printing position of an image to be formed on the sheet based on a measurement result. When the user measures a position of the reference image from the edge of the sheet using a ruler and positional information is acquired through user's manual input, the image forming apparatus adjusts the printing position based on the positional information. An image forming apparatus discussed in Japanese Patent Application Laid-Open No. 2003-173109 causes a reading device to read a sheet on which a reference image has been formed, determines a distance from an edge of the sheet to the reference image from a reading result, and adjusts a printing position based on the distance from the edge of the sheet to the reference image.

SUMMARY OF THE INVENTION

According to an aspect of the present disclosure, an image forming apparatus, which forms an image on a sheet, includes an image forming unit configured to form an image, the image forming unit including a first image forming unit configured to form a first image in a chromatic color and a second image forming unit configured to form a second image in black, an intermediate transfer member configured to transfer the first image and the second image that have been formed by the image forming unit, and a sensor configured to measure a measuring image on the intermediate transfer member, the measuring image including a measuring image in the chromatic color and a measuring image in the black, a first adjustment unit configured to cause the image forming unit to form the measuring image and cause the sensor to measure the measuring image, to adjust an image formation position of the second image using an image formation position of the first image as a reference, a second adjustment unit configured to adjust an image formation area of the image forming unit based on an adjustment condition, an input unit configured to input a user instruction relating to the size of a test image, and a generation unit configured to generate the adjustment condition, the generation unit causing the image forming apparatus to form a first test image in the chromatic color on a sheet, acquiring a user instruction relating to the first test image input from the input unit, and generating a first adjustment condition based on the user instruction relating to the first test image, the generation unit causing the image forming apparatus to form a second test image in the black on a sheet, acquiring a reading result of the second test image from a reading device, and generating a second adjustment condition based on the reading result.

Further features of the present disclosure will become apparent from the following description of exemplary embodiments with reference to the attached drawings.

BRIEF DESCRIPTION OF THE DRAWINGS

FIG. 4 is a table representing respective data relating to sheets.

FIG. 6 is a table representing a relationship among a measurement value, an ideal value, and a deviation amount in the test chart B.

FIG. 9 is a table representing a relationship among a measurement value, an ideal value, and a deviation amount in the test chart A.

FIGS. 15A-15G are image views for illustrating adjustment of a printing position on a sheet.

DESCRIPTION OF THE EMBODIMENTS

Hereinafter, exemplary embodiments of the present disclosure will be described in detail below with reference to attached drawings.

Figure 1:
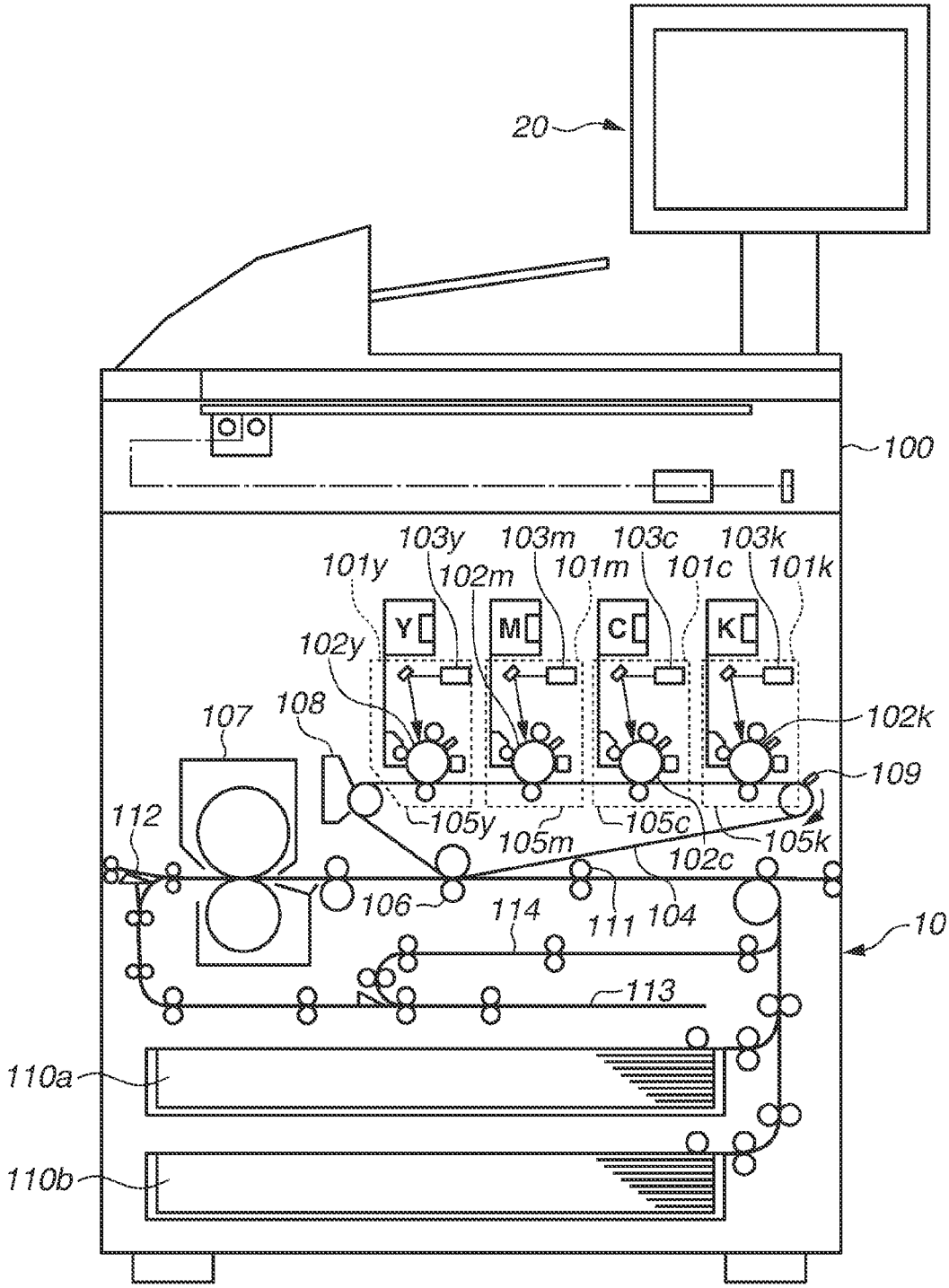
FIG. 1 is a schematic sectional view of an image forming apparatus.

FIG. 1 is a schematic sectional view of an image forming apparatus 10. An image forming apparatus 10 includes a plurality of image forming stations 101*y*, 101*m*, 101*c*, and 101*k*. The image forming station 101*y* forms a cyan image. The image forming station 101*m* forms a magenta image.

The image forming station 101*c* forms a cyan image. The image forming station 101*k* forms a black image. The image forming apparatus 10 includes a scanner 100. The scanner 100 reads a document, and generates image data. The image forming apparatus 10 forms, when image data is transferred from the scanner 100 and a personal computer (PC) (not illustrated), an image on a sheet based on the image data.

A photoconductive drum 102 is driven to have a target rotation speed by a motor (not illustrated). A charging device uniformly charges the photosensitive drum 102. An exposure device 103 exposes the photosensitive drum 102 based on image data. Thus, an electrostatic latent image is formed on the photosensitive drum 102. A developing device develops the electrostatic latent image on the photosensitive drum 102. The developing device contains a developing agent including toner and carrier, and visualizes the electrostatic latent image on the photosensitive drum as a toner image using the toner in the developing agent.

The respective photosensitive drums 102 in yellow (Y), magenta (M), cyan (C), and black (K) are arranged at a predetermined distance from one another. A yellow toner image is formed on the photosensitive drum 102*y*. A magenta toner image is formed on the photosensitive drum 102*m*. A cyan toner image is formed on the photosensitive drum 102*c*. A black toner image is formed on the photosensitive drum 102*k*. The toner images respectively formed on the photosensitive drums 102*y*, 102*m*, 102*c*, and 102*k* are transferred to overlap one another on an intermediate transfer belt 104. Thus, a full-color image is formed on the intermediate transfer belt 104. The intermediate transfer belt 104 functions as an image-bearing member for bearing an image.

Sheets are stored in storage units 110*a* and 110*b*. The sheets in the storage units 110*a* and 110*b* are fed by a sheet feeding roller, and are conveyed to a registration roller 111 along a conveyance path. The registration roller 111 controls a conveyance timing of the sheet and a conveyance speed of the sheet such that the image on the intermediate transfer belt 104 reaches a secondary transfer unit 106 and the sheet reaches the secondary transfer unit 106 at the same timing. The image on the intermediate transfer belt 104 is transferred onto the sheet with a voltage applied from a power supply unit (not illustrated) while the image on the intermediate transfer belt 104 and the sheet are passing through the secondary transfer unit 106. After the image on the intermediate transfer belt 104 has been transferred onto the sheet, the toner remaining on the intermediate transfer belt 104 is cleaned by a belt cleaner 108.

The sheet onto which the image has been transferred is conveyed to a fixing device 107. The fixing device 107 includes a plurality of rollers and heaters. The fixing device 107 heats and presses the image on the sheet, to fix the image on the sheet. The sheet on which the image has been fixed by the fixing device 107 is output from the image forming apparatus 10 by a sheet discharge roller 112.

On the other hand, if an image is formed on both surfaces of a sheet in a two-sided printing mode, the sheet, which has passed through the fixing device 107, is guided to a reversing path 113 by a flapper, and is then conveyed to a two-sided path 114 after the conveyance direction of the sheet is reversed. The sheet, which has been conveyed along the two-sided path 114, is conveyed to a secondary transfer unit 106 after the conveyance speed and the conveyance timing of the sheet are controlled again in the registration roller 111. The image on the intermediate transfer belt is transferred onto the sheet that has been conveyed to the secondary transfer unit 106. The sheet onto which the image has been transferred is discharged onto a sheet discharge tray after the image has been fixed on the sheet in the fixing device 107. Thus, the image is formed on both surfaces of the sheet.

In the image forming apparatus 10 that forms images using toners of a plurality of colors, when a formation position of the image in each of the colors deviates, the tint of the image formed on the sheet changes. In the image forming apparatus 10, a sensor 109 is arranged downstream of the photosensitive drum 102*k* in a direction in which the intermediate transfer belt 104 moves (in a direction indicated by an arrow). The sensor 109 is an optical sensor including a light emitting portion and a light receiving portion. The light emitting portion in the sensor 109 irradiates the intermediate transfer belt 104 with light. The light receiving portion in the sensor 109 receives reflected light from a pattern image on the intermediate transfer belt 104 and outputs an output signal according to the intensity of the received light. The image forming apparatus 10 forms a pattern image for each of the colors on the intermediate transfer belt 104, and detects a relative positional relationship between the pattern image in a reference color and the pattern image in a color other than the reference color based on the output signal of the sensor 109. An image formation position of each image forming station 101 is corrected so that an amount of the color misregistration becomes a target amount or less.

A control block diagram of the image forming apparatus 10 will be described below with reference to FIG. 2. A central processing unit (CPU) 201, which may include one or more processors and one or more memories, is a control circuit that controls each of the units. The CPU 201 corresponds to a processor. A read-only memory (ROM) 202 stores a control program to perform various types of processing in flowcharts described below, which the CPU 201 executes. A random access memory (RAM) 203 is a system work memory for the CPU 201 to operate. A hard disk drive (HDD) 204 stores image data transferred from the scanner 100 and a personal computer (PC) and setting information input from an operation unit 20. A printer engine 150 corresponds to the image forming stations 101*y*, 101*m*, 101*c*, and 101*k*, the secondary transfer unit 106, and the fixing unit 107. As used herein, the term "unit" generally refers to any combination of hardware, firmware, software or other component, such as circuitry, that is used to effectuate a purpose.

The operation unit 20 is an example of a user interface unit. The operation unit 20 includes a display portion and a key input portion. The operation unit 20 has a function of receiving setting information input by the user via the display portion and the key input portion. The operation unit 20 has a function of providing information to the user via the display portion. The key input portion includes a start key for issuing an instruction to start operations such as scanning and copying, a stop key for issuing an instruction to stop the operations such as scanning and copying, and a key pad, for example.

An image processing unit 210 subjects image data to various types of image processing, to correct the image data. The image processing unit 210 may be implemented by an integrated circuit such as an Application Specific Integrated Circuit (ASIC), or may be implemented by the CPU 201 which corrects the image data based on a program previously stored. The image processing unit 210 may be another processor different from the CPU 201.

The image data, which has been corrected by the image processing unit 210, is transferred to the exposure device 103 in the image forming stations 101. The exposure devices 103 in the image forming station 101 is controlled based on the image data that has been corrected by the image processing unit 210. The exposure device 103 exposes the photosensitive drum 102 to form an electrostatic latent image based on the image data, on the photosensitive drum 102. An image forming operation has been described above, and hence description thereof is not repeated.

A printing position correction unit 211 corrects image data so that a position of an image on a sheet becomes a target position. A printing position (image formation position) of an image formed on a sheet by the image forming apparatus 10 may not be an ideal printing position. If a sheet conveyed by the registration roller 111 is inclined, for example, an image is diagonally inclined on the sheet and printed because the inclined sheet passes through the secondary transfer unit 106.

Further, if a pressure distribution of a roller in the fixing device 107 is not uniform, for example, the sheet, which has passed through the fixing device 107, is deformed, and the image on the sheet is inclined. Furthermore, when an image is formed on a first surface of a sheet in two-sided printing, for example, the sheet expands and contracts by application of heat and pressure of the fixing device 107. Therefore, the size of the image formed on the first surface of the sheet and the size of an image formed on a second surface of the sheet differ from each other. In this case, a printing position of the image printed on the first surface of the sheet and a printing position of the image printed on the second surface of the sheet differ from each other.

An inclination of the sheet, which passes through the secondary transfer unit 106, and a deformation amount of the sheet in the fixing device 107 are highly reproducible if the size, the grammage, and the material quality of the sheet remain unchanged. Accordingly, the image forming apparatus 10 deforms a shape of the image formed on the image forming station 101 according to the deformation amount so that the printing position of the image on the sheet becomes an ideal one.

The printing position correction unit 211 converts the image data based on a conversion equation for correcting a deviation in the printing position of the image on the sheet, stored in a sheet management table 400. If the image forming station 101 forms the image based on the image data that has been converted by the printing position correction unit 211, an image which cancels a deviation in a formation position of the image on the sheet is formed on the intermediate transfer belt 104. The printing position correction unit 211 may be implemented by an integrated circuit such as an ASIC. Alternatively, the CPU 201 may perform processing for converting the image data based on a program previously stored, or another processor different from the CPU 201 may perform the conversion processing. The sheet management table 400 stores for each sheet a deviation amount of a printing position created by a printing position calculation unit 213 described below, and a conversion equation for correcting the deviation amount.

An internal temperature within the image forming apparatus 10 rises when a motor is driven, and rises when the heater in the fixing device 107 is turned on. Further, the internal temperature within the image forming apparatus 10 changes based on an ambient temperature. If the internal temperature of the image forming apparatus 10 changes, an exposure position on each of the photosensitive drums 102 varies, for example. Therefore, a relative positional relationship between the image in the reference color formed on the intermediate transfer belt 104 and the image in the color other than the reference color deviates. Thus, a color misregistration occurs in the image formed on the sheet.

Therefore, a color registration adjustment unit 212 calculates based on a detection result of the pattern images formed by each of the image forming stations 101*y*, 101*m*, 101*c*, and 101*k* of respective colors, a deviation amount (amount of the color misregistration) of the pattern image in the other color from the pattern image in the reference color. The color registration adjustment unit 212 determines a correction amount for each image in the other colors which are different from the reference color based on the amount of the color misregistration. The color registration adjustment unit 212 corrects an exposure start timing of a laser beam irradiated from the exposure device 103 based on the correction amount to correct the image formation position of the image formed by each of the image forming stations 101*y*, 101*m*, 101*c*, and 101*k*. The color registration adjustment unit 212 may be implemented by an integrated circuit such as an ASIC. Alternatively, the CPU 201 may correct the exposure start timing based on a program previously stored, or another processor different from the CPU 201 may correct the exposure start timing. In the following description, processing for forming a plurality of pattern images including the pattern image in the reference color and the pattern image in the color different from the reference color and determining a correction amount for each of the images in the other colors different from the reference color is referred to as color registration.

Figure 2:
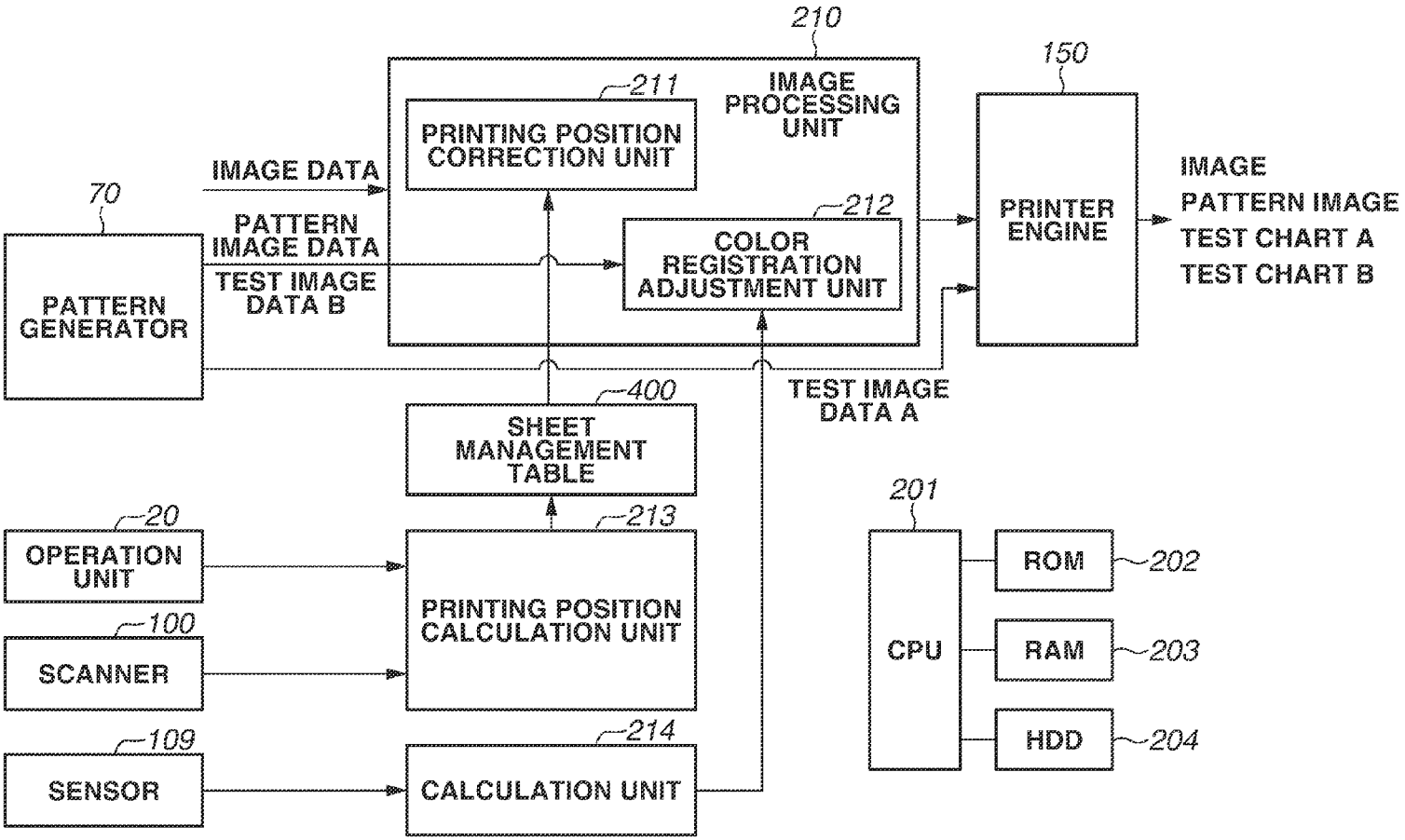
FIG. 2 is a control block diagram of the image forming apparatus.

In a control block diagram of FIG. 2, a pattern generator 70 generates measuring image data. If an instruction to perform color registration to correct a color misregistration in each of the image forming stations 101*y*, 101*m*, 101*c*, and 101*k* is issued, the pattern generator 70 outputs pattern image data. If an instruction to execute a manual adjustment mode for adjusting a printing position of an image on a sheet has been issued based on a result of measuring a measuring image on a test chart A by the user using a ruler, the pattern generator 70 outputs test image data A. If an instruction to execute an automatic adjustment mode for adjusting a printing position of an image on a sheet has been issued based on a result of measuring the measuring image on a test chart B by the user using a scanner, the pattern generator 70 outputs test image data B. Details of the manual adjustment mode and the automatic adjustment mode for adjusting the printing position of the image on the sheet will be described below.

The printing position calculation unit 213 determines a printing position of an image on a sheet, and calculates a difference between the printing position and a target position. The printing position calculation unit 213 stores a calculation result in the sheet management table 400. The printing position calculation unit 213 determines the printing position on the sheet from the measurement result of the test chart A input from the operation unit 20 when the manual adjustment mode is executed. On the other hand, the printing position calculation unit 213 determines the printing position on the sheet from the reading result of the test chart B by the scanner 100 when the automatic adjustment mode is executed.

A calculation unit 214 determines a deviation amount (amount of the color misregistration) of a position of the image formed by each of the image forming stations 101*y*, 101*c*, and 101*k* relative to the image formed by the image forming station 101*m*. In the following description, the image formed by the image forming station 101*m* is referred to as a reference image in the reference color.

(Color Registration)

Figure 3:
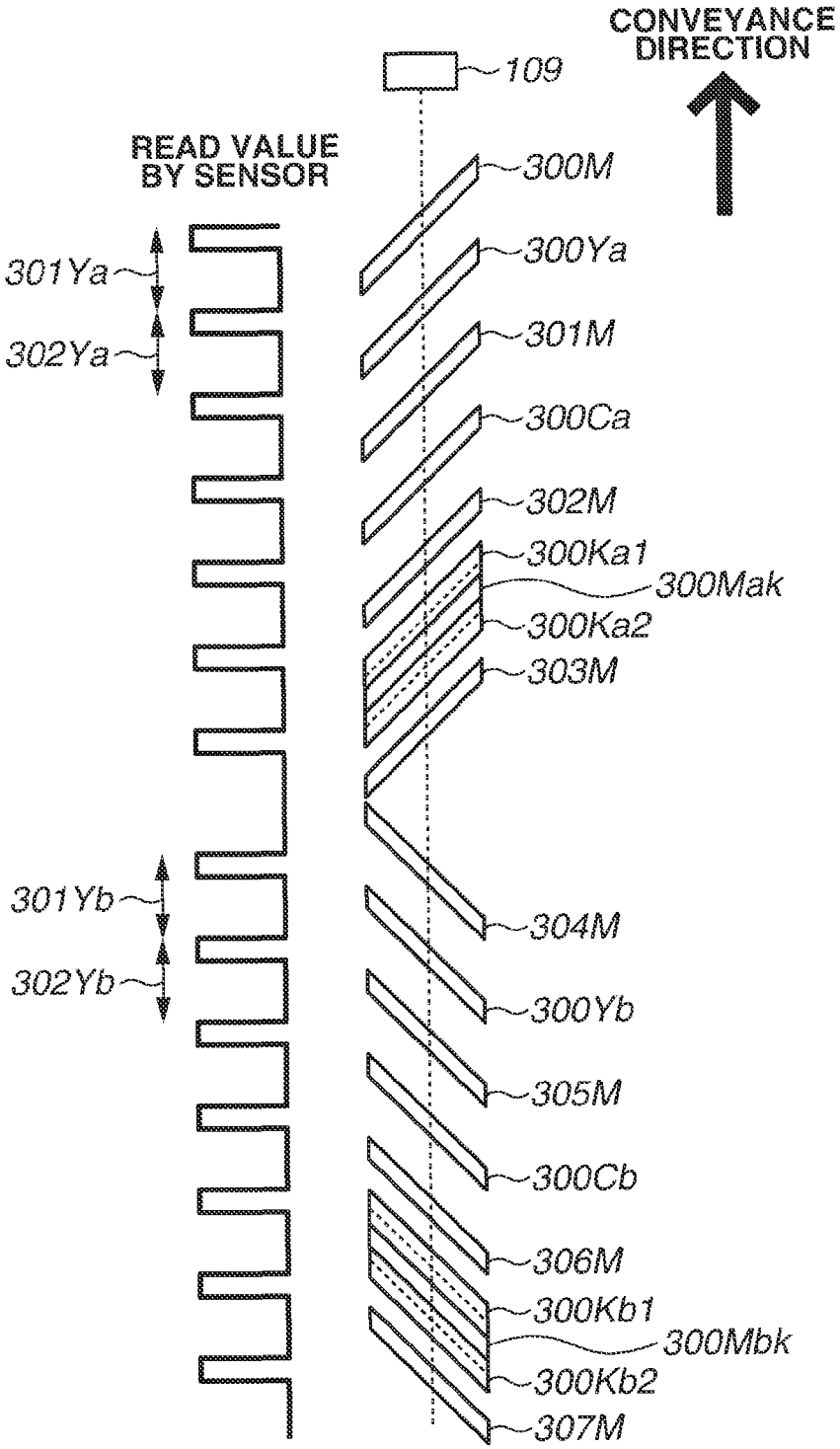
FIG. 3 illustrates a pattern image formed on an intermediate transfer belt and an output signal of a sensor.

Color registration will be described below. FIG. 3 illustrates the pattern image formed on the intermediate transfer belt 104 for detecting an amount of the color misregistration, and the output signal output from the sensor 109. The pattern image is formed for each color on the intermediate transfer belt 104. Pattern images 300M, 301M, 302M, 303M, 304M, 305M, 306M, and 307M in magenta are formed to be at a predetermined distance from one another. Pattern images 300Ya and 300Yb in yellow and pattern images 300Ca and 300Cb in cyan are formed between the pattern images in magenta. A composite pattern image is formed on the intermediate transfer belt 104 to acquire a black image formation position.

Next, a method for detecting an amount of the color misregistration of the pattern image in yellow from the pattern image in magenta will be described below. The sensor 109 outputs a voltage from the light receiving portion according to the intensity of light received in the light receiving portion. If the output voltage of the light receiving portion is larger than a threshold value, the sensor 109 outputs a high-level output signal. On the other hand, if the output voltage of the light receiving portion is smaller than the threshold value, the sensor 109 outputs a low-level output signal.

The calculation unit 214 calculates a deviation amount (amount of the color misregistration) of a yellow image formation position from a magenta image formation position (reference position).

$$\text{Main scanning deviation amount}=\{(302Ya-301Ya)/2-(302Yb-301Yb)/2\}/2 \quad \text{(Equation 1)}$$

$$\text{Sub-scanning deviation amount}=\{(302Ya-301Ya)/2+(302Yb-301Yb)/2\}/2 \quad \text{(Equation 2)}$$

The main scanning direction is a direction perpendicular to a direction in which the intermediate transfer belt 104 is conveyed, and the sub-scanning direction is a direction in which the intermediate transfer belt 104 is conveyed. Similar calculation is also performed for cyan and black.

In the equations 1 and 2, time from when the sensor 109 has detected the pattern image in magenta to time when the sensor 109 has detected the pattern image in yellow are respectively 301Ya, 301Yb, 302Ya, and 302Yb.

The pattern image in magenta is the reference pattern image. This is because the intensity of reflected light from the pattern image in black is low. A difference between the intensity of the reflected light from the pattern image in black and the intensity of the reflected light from the intermediate transfer belt 104 is small. Therefore, the sensor 109 may erroneously detect a formation position of the pattern image in black. Thus, the reference pattern image is a pattern image formed using toner in the color different from black.

The intensity of the reflected light from the pattern image in black is low. Therefore, the image forming apparatus 10 forms a composite pattern image to detect the black image formation position. The composite pattern image is an image formed by overlaying the pattern images 300Ka1, 300Ka2, 300Kb1, and 300Kb2 in black on pattern images 300Mak and 300Mbk in magenta. In the composite pattern image, the pattern images 300Ka1 and 300Ka2 in black are overlaid on the pattern image 300Mak in magenta, arranged at a predetermined distance from each other. More specifically, in the composite pattern image, a part of the pattern image 300Mak in magenta is exposed at a gap between the pattern images 300Ka1 and 300Ka2 in black. Thus, when the black image formation position has changed, a timing at which the light received by the sensor 109 exceeds a threshold value, changes.

The color registration adjustment unit 212 corrects a deviation amount in the main scanning direction, a deviation amount in the sub-scanning direction, a writing position in the main scanning direction, a writing position in the sub-scanning direction, a magnification of the image in the main scanning direction, and a magnification of the image in the sub-scanning direction based on a measurement result of the sensor 109. A method for correcting the deviation amount in the main scanning direction, the deviation amount in the sub-scanning direction, the writing position in the main scanning direction, the writing position in the sub-scanning direction, the magnification of the image in the main scanning direction, and the magnification of the image in the sub-sub-scanning direction is known, and hence description thereof is omitted.

(Printing Position Adjustment Control)

Printing position adjustment control to correct a printing position of an image on a sheet to be an ideal printing position will be described below. FIG. 4 is a table representing data relating to a sheet used for printing by the image forming apparatus 10. Examples of the sheet used for printing in the image forming apparatus 10 include a standard sheet, a sheet already estimated by a printer manufacturer, and a user-defined sheet obtained by customizing attribute information about the standard sheet or the estimated sheet, by a user. Data relating to the plurality of sheets is stored in the sheet management table 400.

Details of data to be registered in the sheet management table 400 will be described. A sheet name (411) is information for distinguishing sheets used for printing from one another. A sheet length (412) in the sub-scanning direction, a sheet length (413) in the main scanning direction, a grammage (414) of the sheet, and a surface property (415) of the sheet are physical properties of the sheet used for printing. The surface property (415) of the sheet is an attribute for representing the physical property of a surface of the sheet, for example, it includes "coated" indicating that the sheet has been subjected to surface coating to raise glossiness and "embossed" indicating that the surface of the sheet is irregular. A color (416) of the sheet is an attribute for representing a background color of the sheet. A preprinted sheet (417) is information indicating whether the sheet used for printing is a preprinted sheet.

The image forming apparatus 10 corrects a deviation of a printing position of an image on the sheet at the time of performing printing so that the image is printed at an ideal printing position on the sheet. A deviation amount (420) of a printing position on a front surface of the sheet is information representing a deviation amount from an ideal printing position on the front surface of the sheet. On the other hand, a deviation amount (421) of a printing position on a rear surface of the sheet is information representing a deviation amount from an ideal printing position on the rear surface of the sheet.

Examples of the deviation amounts (420 and 421) of the printing position include a deviation amount of a printing position in the sub-scanning direction on the sheet (hereinafter referred to as a deviation amount of a lead position). The lead position means a printing start position of an image using a leading edge as a start point in the conveyance direction of the sheet. An initial value of the lead position is zero.

Furthermore, examples of the deviation amounts (420 and 421) of the printing position include a deviation amount of a printing position in the main scanning direction on the sheet (hereinafter referred to as a deviation amount of a side position). The side position means a printing start position of an image using a left edge as a starting point in the conveyance direction of the sheet. An initial value of the side position is zero.

Furthermore, examples of the deviation amounts (420 and 421) of the printing position include a deviation amount of an image length (a magnification ratio to an ideal length) in the sub-scanning direction and a deviation amount of the image length (a magnification ratio to an ideal length) in the main scanning direction. Initial values of a sub-scanning magnification and a main scanning magnification are zero.

The user measures with a ruler or the like the test chart A having the measuring image formed thereon using the magenta toner, and the printing position calculation unit 213 calculates the deviation amounts (420 and 421) of the printing position based on the measurement result input from the PC or the operation unit 20. Alternatively, the printing position calculation unit 213 calculates the deviation amounts (420 and 421) of the printing position based on the position of the measuring image on the test chart B, which is formed using the black toner, after the scanner 100 reads the test chart B. Details of the test charts A and B on which the measuring images are printed will be described below with reference to FIGS. 5 and 6. If the printing position adjustment control is performed, attribute information about the sheet registered in the sheet management table 400 is added or updated in the sheet management table 400.

The image forming apparatus 10 has two modes, i.e., a manual adjustment mode and an automatic adjustment mode when performing the printing position adjustment control. The test chart A printed by the image forming apparatus 10 when the manual adjustment mode is executed and the test chart B printed by the image forming apparatus 10 when the automatic adjustment mode is executed differ from each other.

Figure 5:
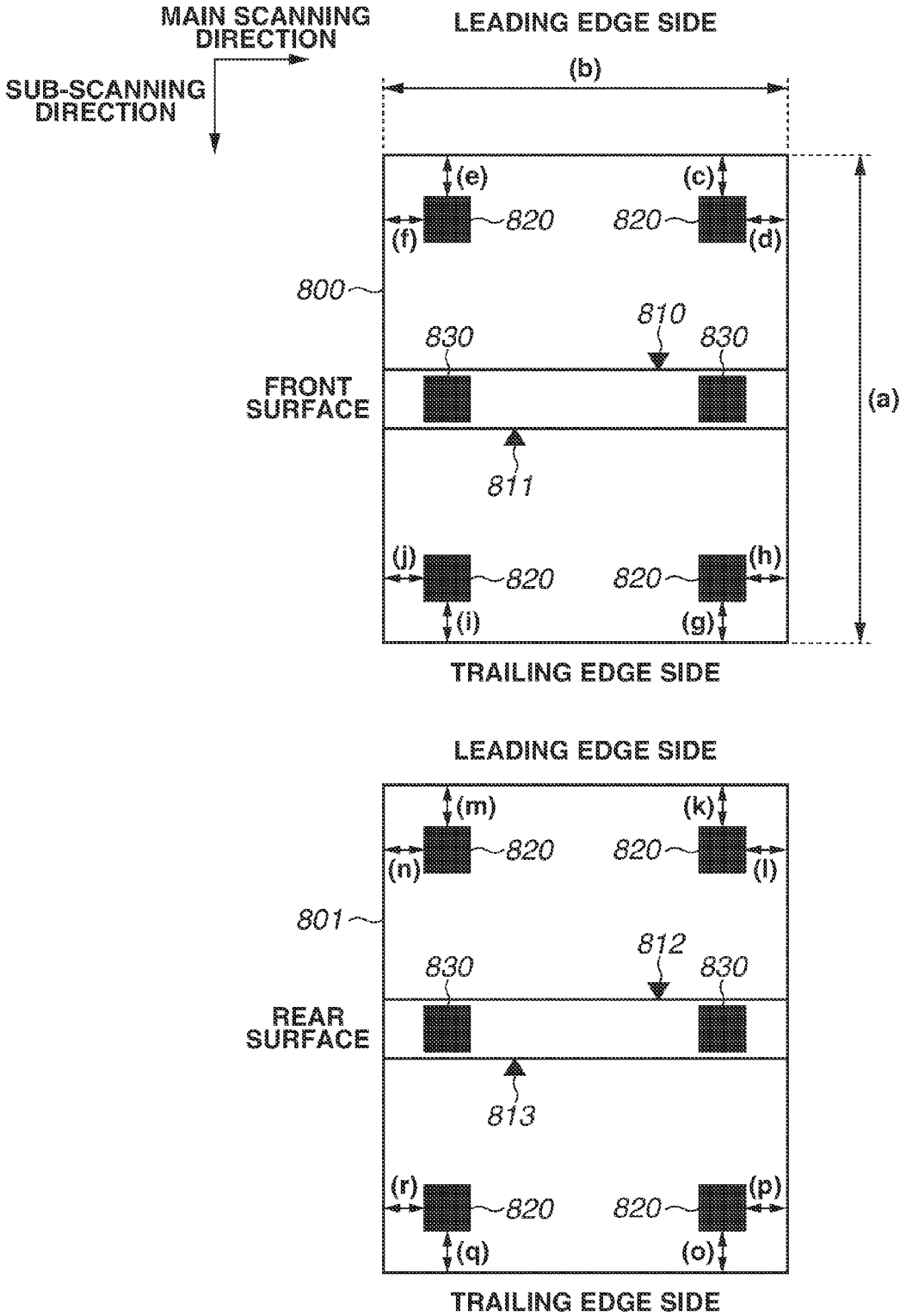
FIG. 5 is a schematic view of a test chart B.

FIG. 5 is a schematic view of the test chart B printed by the image forming apparatus 10 when the automatic adjustment mode is executed. Eight measuring images 820 are formed on a front surface 800 and a rear surface 801 of the test chart B. The measuring image 820 is formed using toner in a color that greatly differs in reflectance from a sheet. The measuring image 820 is formed using the black toner, for example. Thus, a distance from an edge of the sheet to the measuring image 820 in the data of the test chart B read by the scanner 100 can be detected with high accuracy.

A total of eight measuring images are formed at four corners of the sheet on both the surfaces of the test chart B. The measuring image 820 is printed at a position located at a predetermined distance from an edge of the test chart B if its printing position is an ideal printing position. By measuring a distance from the edge of the sheet to the measuring image 820, a deviation amount of the printing position is found.

In the schematic view of the test chart B illustrated in FIG. 5, reference sings (a) to (r) are assigned so that sites at which the printing position calculation unit 213 acquires sizes in the test chart B read by the scanner 100 can be found. However, the reference signs may not necessarily be assigned in the test chart B actually printed. The reference sign (a) indicates a length in a direction perpendicular to a conveyance direction of the test chart B, and the reference sign (b) indicates a length in the conveyance direction of the test chart B. Reference signs (c) to (r) respectively indicate distances from edges of the sheet to the measuring image 820.

The scanner 100 reads the front surface of the test chart B in twice, and reads the rear surface of the test chart B in twice. Thus, marks 810, 811, 812, and 813 are also formed in the test chart B as marks of positions at which the user places the test chart B on the scanner 100. For example, the color of the mark 810 is red, the color of the mark 811 is blue, the color of the mark 812 is cyan, and the color of the mark 813 is magenta. Thus, the user can designate the order in which the scanner 100 reads the test chart B.

In the first reading operation, the scanner 100 reads the front surface of the sheet from a leading edge to a substantially central portion of the sheet. In the second reading operation, the scanner 100 reads the front surface of the sheet from a trailing edge to the substantially central portion of the sheet. In the third reading operation, the scanner 100 reads the rear surface of the sheet from a leading edge to a substantially central portion of the sheet. In the fourth reading operation, the scanner 100 reads the rear surface of the sheet from a trailing edge to the substantially central portion of the sheet.

The printing position calculation unit 213 synthesizes read data on the side of the leading edge of the test sheet B and read data on the side of the trailing edge of the test sheet B, to find the lengths (a) to (r). A mark 830 used to synthesize the read data on the side of the leading edge and the read data on the side of the trailing edge is formed in the test sheet B. A total of four marks 830 (two marks 830 on the front surface and two marks 830 on the rear surface) are formed on the test sheet B. The read data on the side of the leading edge of the sheet and the read data on the side of the trailing edge of the sheet are synthesized so that coordinates at a central position of the mark 830 in the read data on the leading edge of the sheet matches coordinates at a central position of the mark 830 in the read data on the trailing edge of the sheet, to generate read data corresponding to one page.

A method for the printing position calculation unit 213 to calculate a deviation amount of a printing position based on read data in the automatic adjustment mode will be described below with reference to FIG. 6. FIG. 6 is a table 700 indicating operational expressions used to find a "lead position", a "side position", a "main scanning magnification", a "sub-scanning magnification", and a deviation amount of a printing position based on the read data. Each of the operational expressions in the table 700 is stored in the HDD 204.

A measurement value 710 indicates the operational expression for calculating each of the "lead position", the "side position", the "main scanning magnification", and the "sub-scanning magnification" on the front surface 800 and the rear surface 801 of the sheet. An ideal value (711) indicates target values of the "lead position", the "side position", the "main scanning magnification", and the "sub-scanning magnification" on the front surface 800 and the rear surface 801 of the test chart B formed on the sheet.

The printing position calculation unit 213 calculates the "lead position" on the front surface 800 of the test chart B based on the measurement values (c) and (e) illustrated in FIG. 5. The lead position indicates an average value of a distance from an edge of the test chart B at the head in the conveyance direction of the sheet to the corresponding measuring image 820.

The printing position calculation unit 213 calculates the "side position" on the front surface of the test chart B based on the measurement values (f) and (j) illustrated in FIG. 5. The side position indicates an average value of a distance from an edge of the test chart B at the left side in the conveyance direction of the sheet to the corresponding measuring image 820.

The printing position calculation unit 213 calculates the "main scanning magnification" on the front surface of the test chart B based on the measurement values (b), (d), (f), (h), and (j) illustrated in FIG. 5. The main scanning magnification indicates an average value of distances among the measuring images 820 arranged on the same scanning line in the main scanning direction.

The printing position calculation unit 213 calculates the "sub-scanning magnification" on the front surface of the test chart B based on the measurement values (a), (c), (e), (g), and (i) illustrated in FIG. 5. The sub-scanning magnification indicates an average value of distances among the measuring images 820 arranged on the same scanning line in the sub-scanning direction.

The ideal values (711) corresponding to the "lead position" and the "side position" are respectively 1 cm. Each of the measuring images 820 is to be printed at a position located 1 cm apart from the edge of the test chart B corresponding thereto.

The ideal value (711) corresponding to the "main scanning magnification" is a value obtained by subtracting 2 cm from the sheet length in the main scanning direction of each of the sheets registered in the sheet management table 400. Similarly, the ideal value (711) corresponding to the "sub-scanning magnification" is a value obtained by subtracting 2 cm from the sheet length in the sub-scanning direction of each of the sheets registered in the sheet management table 400. The printing position calculation unit 213 calculates an ideal value corresponding to the "main scanning direction" and an ideal value corresponding to the "sub-scanning magnification" using data representing the "sheet length in the main scanning direction" and the "sheet length in the sub-scanning direction".

A deviation amount 712 of a printing position illustrated in FIG. 6 indicates an operational expression for calculating a deviation amount between a position of the test chart B formed on the sheet and a target position. The deviation amount (712) of the printing position in each of the "lead position", the "side position", the "main scanning magnification", and the "sub-scanning magnification" is calculated using the corresponding measurement value (710) and ideal value (711).

More specifically, the printing position calculation unit 213 subtracts the ideal value (711) from the measurement value (710), to calculate the deviation amount (712) of the printing position corresponding to each of the "lead position" and the "side position" (the unit is "mm"). The printing position calculation unit 213 divides a value obtained by subtracting the ideal value (711) from the measurement value (710), by the ideal value (711), to calculate the deviation amount (712) of the printing position corresponding to each of the "main scanning magnification" and the "sub-scanning magnification" (the unit is "%"). The printing position calculation unit 213 registers the deviation amount (712) of the printing position as attribute information about the sheet in the sheet management table 400.

The test chart A printed by the image forming apparatus 10 when the manual adjustment mode is executed will be described with reference to FIG. 7. A measuring image 850 representing a position, which is to be measured by the user, is formed on a front surface 802 and a rear surface 803 of the test chart A. The measuring image 850 on the test chart A is an image different from the measuring image 820 on the test chart B printed in the automatic adjustment mode. The measuring image 850 is formed in an arrow shape which can be easily measured by the user using a ruler.

The image forming station 101*m* forms an arrow line of the measuring image 850 as a reference image in the color registration. Thus, even if the color registration is performed after the test chart A is printed, a color misregistration of the image formed on the intermediate transfer belt 104 can be suppressed. This is because in the color registration, the formation position of the image in the other color is corrected relative to the formation position of the magenta image.

Figure 7:
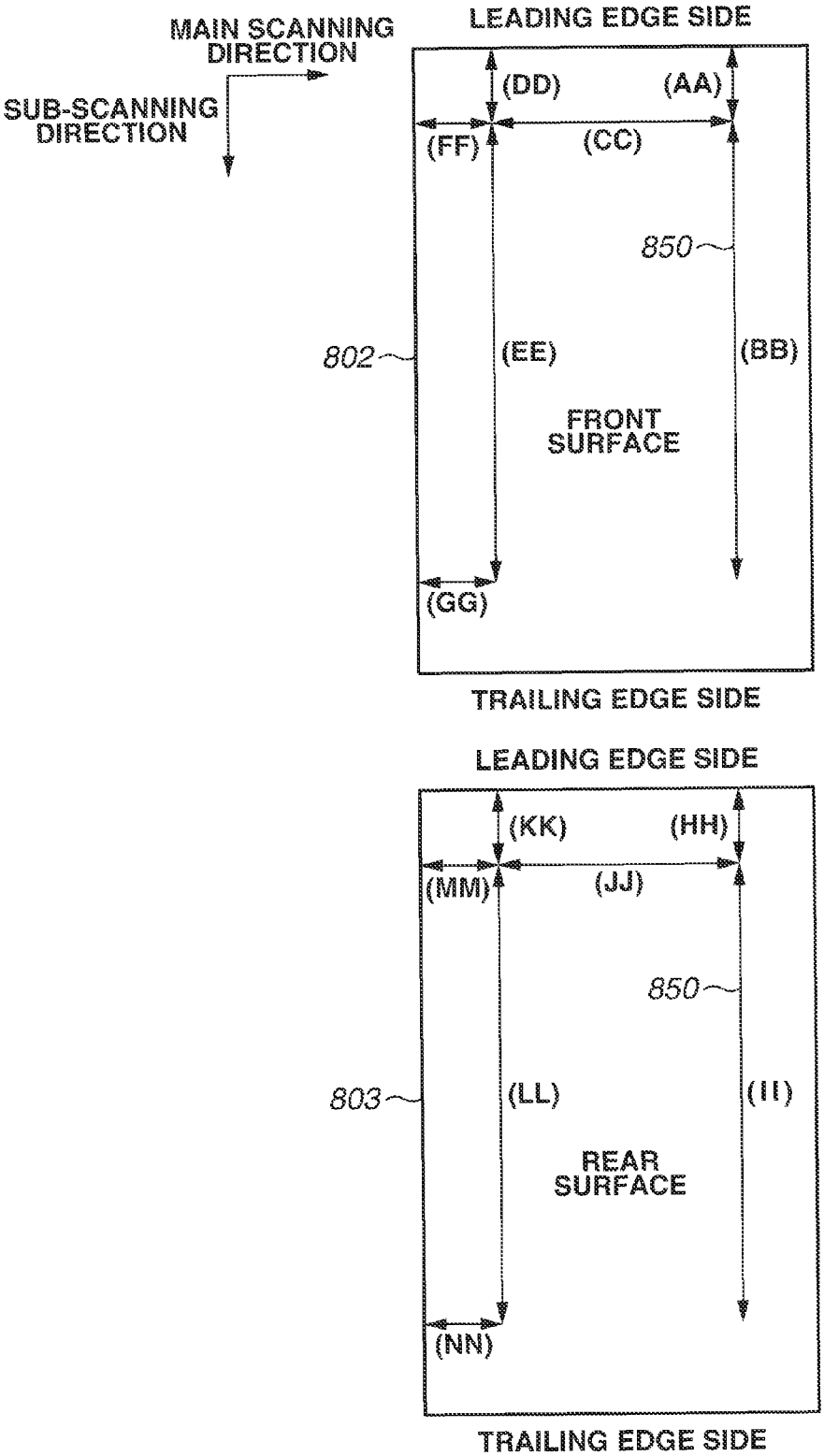
FIG. 7 is a schematic view of a test chart A.
Figure 8:
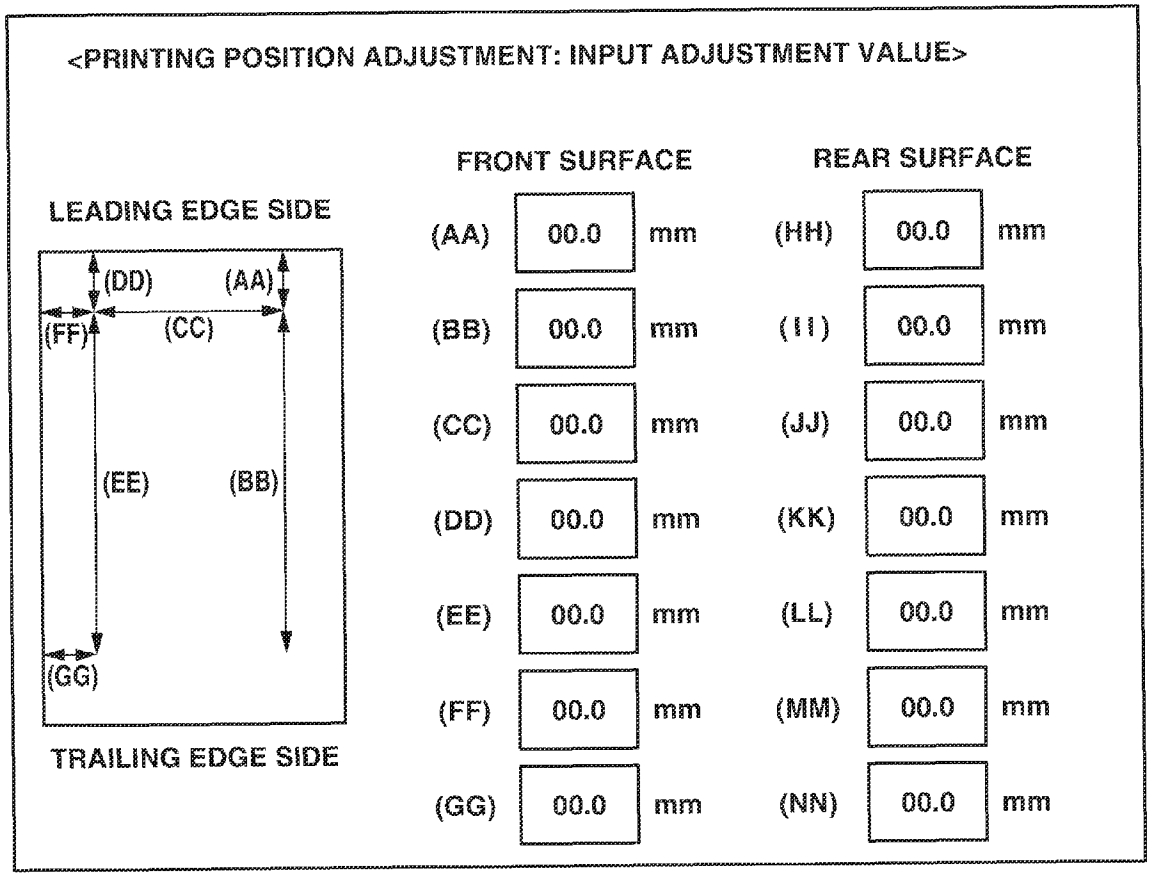
FIG. 8 is a schematic view of an input screen for inputting a measurement result of the test chart A.

The user measures (AA) to (NN) on the front surface 802 and the rear surface 803 of the test chart A illustrated in FIG. 7, and inputs respective measurement results using the operation unit 20. FIG. 8 illustrates an input screen for the front surface 802 displayed on the display portion in the operation unit 20 when the manual adjustment mode is executed. The printing position calculation unit 213 calculates the deviation amount of the printing position based on the information input from the operation unit 20.

A method for calculating the deviation amount of the printing position in the manual adjustment mode will be described with reference to FIG. 9. FIG. 9 is a table 900 indicating operational expressions used to find a "lead position", a "side position", a "main scanning magnification", a "sub-scanning magnification", and a deviation amount of a printing position based on the information input from the operation unit 20. Each of the operational expressions in the table 900 is stored in the HDD 204.

A deviation amount (912) of a printing position, which has been calculated by the printing position calculation unit 213, is registered as attribute information about a sheet in the sheet management table 400.

A method for matching an image formed on a front surface of the sheet with an image formed on a rear surface of the sheet even when an image is formed diagonally to the sheet will be described as follows.

FIG. 15A is an image view illustrating an example in which an image is formed diagonally to a sheet. In FIG. 15A, when coordinates at the upper left of the sheet is set to (0, 0), coordinates at four corners of the image are (x11, y11), (x12, y12), (x13, y13), and (x14, y14). If the image is formed diagonally to the sheet, the test charts A and B are formed diagonally to the sheet.

The printing position calculation unit 213 determines how the image on the sheet is printed based on the information input from the operation unit 20 when the manual adjustment mode is executed. The printing position calculation unit 213 determines how the image on the sheet is printed based on the reading result of the test chart B by the scanner 100 when the automatic adjustment mode is executed.

The printing position calculation unit 213 calculates coordinates, as described below, based on the information input from the operation unit 20 when the manual adjustment mode is executed. x11=FF, y11=DD, x12=CC+FF, y12=AA, x13=GG, y13=DD+EE, x14=GG+CC, and y14=AA+BB.

The printing position calculation unit 213 calculates coordinates, as described below, from the reading result by the scanner 100. x11=f, y11=e, x12=b−d, y12=c, x13=j, y13=a−i, x14=b−h, and y14=a−g.

The printing position calculation unit 213 then connects (x11, y11) and (x12, y12) with a straight line, connects (x11, y11) and (x13, y13) with a straight line, connects (x12, y12) and (x14, y14) with a straight line, and connects (x13, y13) and (x14, y14) with a straight line.

The printing position calculation unit 213 determines a conversion equation 1 for correcting image data so that the straight line connecting (x11, y11) with (x12, y12) becomes perpendicular to a straight line connecting (x11, y11) with (x13, y13). At this time, a position (x101, y101) corresponding to half the length of the straight line connecting (x11, y11) with (x12, y12) is used as a reference, as illustrated in FIG. 15B.

The conversion equation 1 is a calculation equation for correcting a writing position in the sub-scanning direction of an image at each position in the main scanning direction. This conversion equation 1 corresponds to a first right angle correction condition. Coordinates (x11, y11), (x12, y12), (x13, y13), and (x14, y14) of the image are respectively converted into (x21, y21), (x22, y22), (x23, y23), and (x24, y24) based on the first right angle correction condition.

Then, the printing position calculation unit 213 determines a conversion equation 2 for correcting image data so that a straight line connecting (x23, y23) with (x24, y24) at trailing edges in the conveyance direction of the sheet becomes perpendicular to a straight line connecting (x21, y21) with (x23, y23). At this time, a position (x102, y102) corresponding to half the length of the straight line connecting (x23, y23) with (x24, y24) is used as a reference, as illustrated in FIG. 15C.

The conversion equation 2 is a calculation equation for correcting a magnification of the image in the sub-scanning direction at each position in the main scanning direction. This conversion equation 2 corresponds to a second right angle correction condition. Coordinates (x23, y23), and (x24, y24) are respectively converted into (x33, y33) and (x34, y34) based on the second right angle correction condition.

Then, the printing position calculation unit 213 determines a conversion equation 3 for correcting image data so that the length of the image in the main scanning direction becomes an ideal length and the length of the image in the sub-scanning direction becomes an ideal length. At this time, the center of the image is used as a reference, as illustrated in FIG. 15D.

The conversion equation 3 is a calculation equation for correcting a magnification of the image in the main scanning direction and correcting a magnification of the image in the sub-scanning direction. This conversion equation 3 corresponds to an expansion/contraction correction condition. Coordinates (x21, y21), (x22, y22), (x33, y33), and (x34, y34) are respectively converted into (x41, y41), (x42, y42), (x43, y43), and (x44, y44) based on the expansion/contraction correction condition.

Then, the image data is corrected so that left edges ((x103, y103) (x104, y104)) of the sheet and left edges ((x41, y41) (x43, y43)) of the image are parallel to each other, as illustrated in FIG. 15E. The printing position calculation unit 213 determines a conversion equation 4 for correcting image data so that the image based on the image data is rotated by an angle of θ2.

The conversion equation 4 is a calculation equation for rotating the image by an angle of θ2. This conversion equation 4 corresponds to a rotation correction condition. Coordinates (x42, y42), (x43, y43), and (x44, y44) of the image are respectively converted into (x52, y52), (x53, y53), and (x54, y54) based on a rotation correction condition.

The printing position calculation unit 213 determines a conversion equation 5 for correcting a writing position in the main scanning direction and a writing position in the sub-scanning direction so that a central position of the sheet and a central position of the image become the same, as illustrated in FIG. 15F.

The conversion equation 5 is a calculation equation for correcting the writing position in the main scanning direction and the writing position in the sub-scanning direction. This conversion equation 5 corresponds to an offset condition. A printing position of the image, which has been converted based on the offset condition, becomes an ideal printing position, as illustrated in FIG. 15G.

In the foregoing description, the image itself to be printed on the sheet is shifted by a predetermined amount while being rotated based on a length from an edge of the sheet to the measuring image 820, and a deviation of the printing position is adjusted. When the manual adjustment mode is executed, the printing position calculation unit 213 determines the conversion equations 1 to 5 based on the information relating to the front surface input from the operation unit 20. On the other hand, when the automatic adjustment mode is executed, the printing position calculation unit 213 determines the conversion equations 1 to 5 based on the reading result of the front surface of the test chart B by the scanner 100. The conversion equations 1 to 5 for the front surface correspond to a second correction condition for the first surface of the sheet. The conversion equations 1 to 5 for the front surface determined by the printing position calculation unit 213 are stored in the sheet management table 400.

A position of the image on the rear surface of the sheet is also similarly corrected. When the manual adjustment mode is executed, the printing position calculation unit 213 determines the conversion equations 1 to 5 based on the information relating to the rear surface input from the operation unit 20. On the other hand, when the automatic adjustment mode is executed, the printing position calculation unit 213 determines the conversion equations 1 to 5 based on the reading result of the rear surface of the test chart B by the scanner 100. The conversion equations 1 to 5 for the rear surface correspond to a second correction condition for the second surface of the sheet. The conversion equations 1 to 5 for the rear surface determined by the printing position calculation unit 213 are stored in the sheet management table 400.

When the image forming apparatus 10 forms the image on the sheet based on image data, the printing position correction unit 211 converts the image data based on the conversion equations 1 to 5 that have been read out in step S100. Thus, the deviation of the printing position of the image on the sheet is adjusted so that the printing position matches a predetermined position.

(Sequence)

Figure 10:
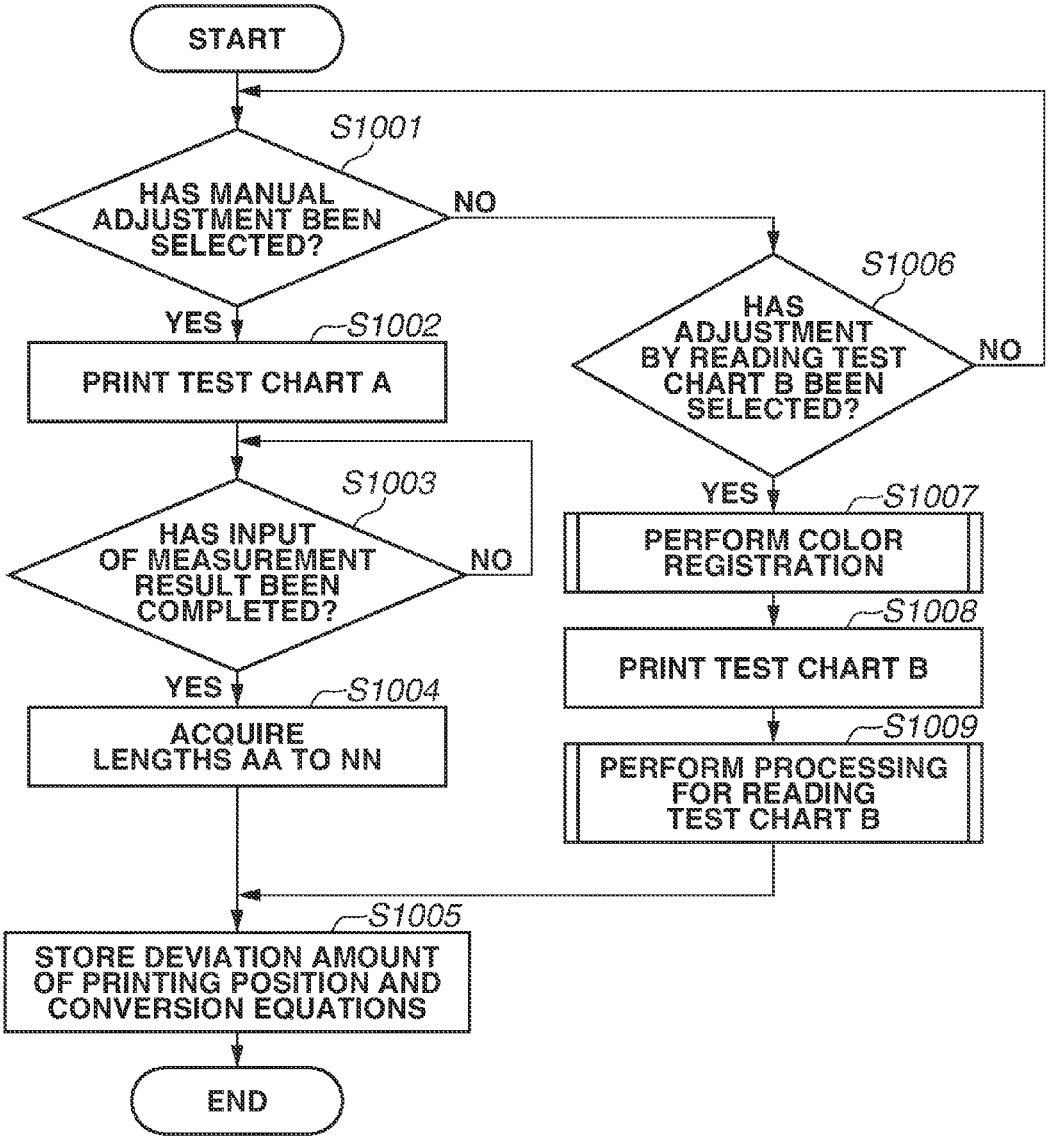
FIG. 10 is a flowchart illustrating printing position adjustment control.

Printing position adjustment control performed when the user presses a switch for performing the printing position adjustment control of the operation unit 20 will be described below with reference to a flowchart of FIG. 10. The CPU 201 reads out a control program stored in the ROM 202, to perform the printing position adjustment control.

Figure 13:
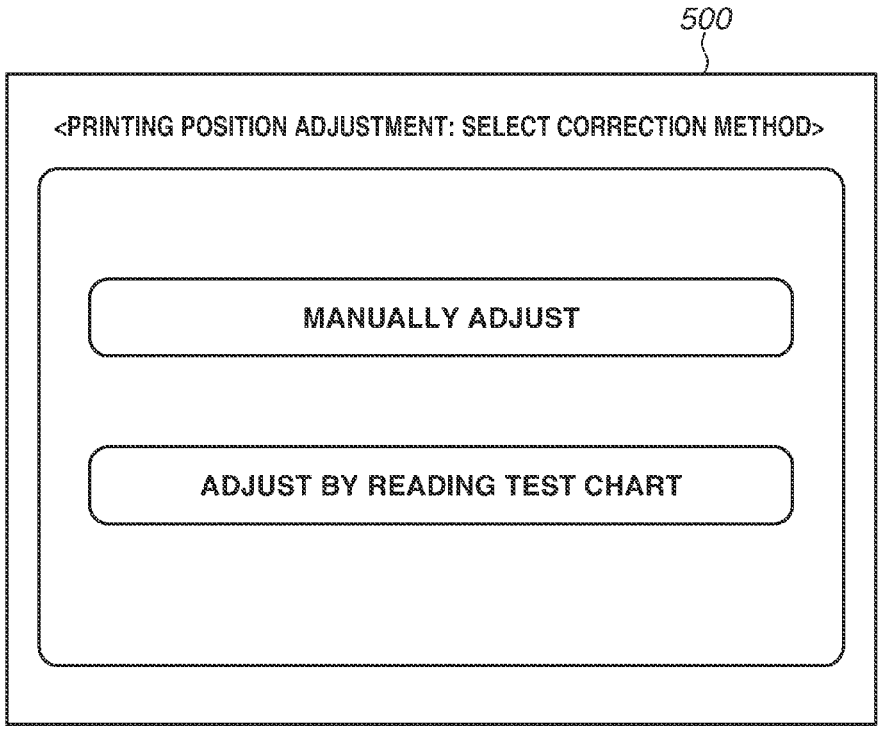
FIG. 13 is a schematic view of a selection screen for selecting a method for adjusting a printing position.

In step S1001, the CPU 201 first displays a correction method selection screen 500 illustrated in FIG. 13 on the display portion in the operation unit 20, to determine whether manual adjustment has been selected. If the manual adjustment has been selected by the user (YES in step S1001), an instruction to execute a manual adjustment mode is input to the CPU 201 from the operation unit 20.

On the other hand, if the manual adjustment has not been selected (NO in step S1001), then in step S1006, the CPU 201 reads the test chart B, to determine whether automatic adjustment for adjusting a printing position on a sheet has been selected. If the automatic adjustment has not been selected (NO in step S1006), the processing proceeds to step S1001. More specifically, the CPU 201 determines whether an automatic adjustment mode has been selected or the manual adjustment mode has been selected in step S1001 and step S1006.

The operation unit 20 functions as a display portion that enables the user to select whether to execute the automatic adjustment mode or the manual adjustment mode, as a method for adjusting the printing position. Further, the operation unit 20 also functions as an input unit to input an instruction to select an operation mode to be used among operation modes including the manual adjustment mode (first mode) and the automatic adjustment mode (second mode).

If the user has selected the manual adjustment mode (YES in step S1001), then in step S1002, the CPU 201 controls the printer engine 150, to print the test chart A. In step S1002, the CPU 201 causes the pattern generator 70 to output the test image data A to the printer engine 150, and controls the printer engine 150 to print the test chart A. At this time, the magenta image forming station 101*m* forms the measuring image 850 included in the test chart A. Therefore, the test chart A is printed without performing color registration by the color registration adjustment unit 212.

In step S1003, the CPU 201 then causes the operation unit 20 to display an input image for inputting a measurement result, and stands by until the user finishes inputting a measurement result of the test chart A from the operation unit 20. When input work by the user is completed, then in step S1004, the CPU 201 acquires information input to the operation unit 20. In step S1005, the CPU 201 calculates the deviation amount of the printing position and the conversion equations 1 to 5 based on the table 900 illustrated in FIG. 9, and stores the deviation amount and the conversion equations 1 to 5 in the sheet management table 400. In steps S1004 to S1005, the printing position calculation unit 213 calculates the conversion equations 1 to 5 for the front surface of the sheet and the conversion equations 1 to 5 for the rear surface of the sheet based on the deviation amount of the printing position of the image on the sheet that has been input from the operation unit 20. When the deviation amount of the printing position and the conversion equations 1 to 5 are stored in the sheet management table 400 in the manual adjustment mode, the CPU 201 ends the printing position adjustment control.

If the manual adjustment mode has been selected by the user (YES in step S1006), then in step S1007, the CPU 201 performs color registration. The color registration to be performed in step S1007 will be described with reference to FIG. 11. When the color registration is performed, the amount of the calculation unit 214 determines the amount of the color misregistration based on the measurement result of the pattern image by the sensor 109.

In step S1008, the CPU 201 controls the printer engine 150 to print the test chart B after the color registration has been performed. In step S1008, the CPU 201 causes the pattern generator 70 to output the test image data B, and causes the color registration adjustment unit 212 in the image processing unit 210 to correct the test image data B based on the amount of the color misregistration. The printer engine 150 prints the test chart B based on the image data output from the image processing unit 210.

In step S1009, the CPU 201 performs processing for reading the test chart B after printing the test chart B. When the reading processing is performed, the printing position calculation unit 213 calculates the deviation amount of an image printing position relative to the sheet using the expressions in the table 700 based on the reading result by the scanner 100. The reading processing to be performed in step S1009 will be described with reference to FIG. 12.

The CPU 201 finds the deviation amount of the image printing position relative to the sheet in the reading processing, and then the processing proceeds to step S1005. In step S1005, the CPU 201 causes the printing position calculation unit 213 to store the deviation amount of the printing position and the conversion equations 1 to 5 in the sheet management table 400. When the deviation amount of the printing position and the conversion equations 1 to 5 are stored in the sheet management table 400 in the automatic adjustment mode, the CPU 201 ends the printing position adjustment control.

The measuring image 820 to be formed on the test chart B is formed using the black toner by the black image forming station 101*k*. Thus, the intensity of reflected light from the measuring image 820 is lower than the intensity of reflected light from the sheet. Therefore, the reading signal of the scanner 100 steeply changes so that a distance from the edge of the sheet to an edge of the measuring image 820 can be found with high accuracy.

The reflectance of the black toner is lower than the reflectance of the yellow toner, the reflectance of the magenta toner, and the reflectance of the cyan toner. Consequently, if the measuring image 820 using the black toner is formed, an edge of the measuring image 820 can be detected from read data with higher accuracy than when a measuring image using the toner in the color other than black is formed.

From the foregoing reason, in a configuration in which the measuring image 820 is formed using the black toner, the position of the measuring image 820 on the sheet can be obtained with high accuracy when the scanner 100 reads the test chart B.

However, a formation position of the black image formed by the black image forming station 101*k* may change when the color registration is performed. This is because the reference image in the color registration is the magenta image.

If the automatic adjustment mode is executed without performing the color registration, the printing position of the magenta image on the sheet may not be an ideal printing position. However, since the formation position of the image in the color other than magenta is corrected in the color registration, the formation position of the magenta image cannot be changed even if the color registration is performed. If the color registration is performed after the automatic adjustment mode is executed, the formation position of the black image is changed to overlap with the formation position of the magenta image. Therefore, a printing position of an image (full-color image) on the sheet differs from an ideal printing position.

The CPU 201 performs the color registration before the measuring image 820 is formed when the instruction to execute the automatic adjustment mode has been issued. Thus, the formation position of the black image in the image forming station 101*k* becomes the same as the formation position of the magenta image in the image forming station 101*m*. More specifically, a deviation amount of the printing position of the measuring image 820 on the sheet becomes equal to the deviation amount of the printing position of the magenta image on the sheet.

Thus, even if a color misregistration has occurred after the automatic adjustment mode has been executed, the formation position of the magenta image on the sheet does not change. Therefore, in the color registration, if the formation position of the image in the color other than magenta is corrected, a color misregistration of the image formed on the sheet is corrected, and the printing position of the image on the sheet is also maintained at an ideal printing position.

Figure 11:
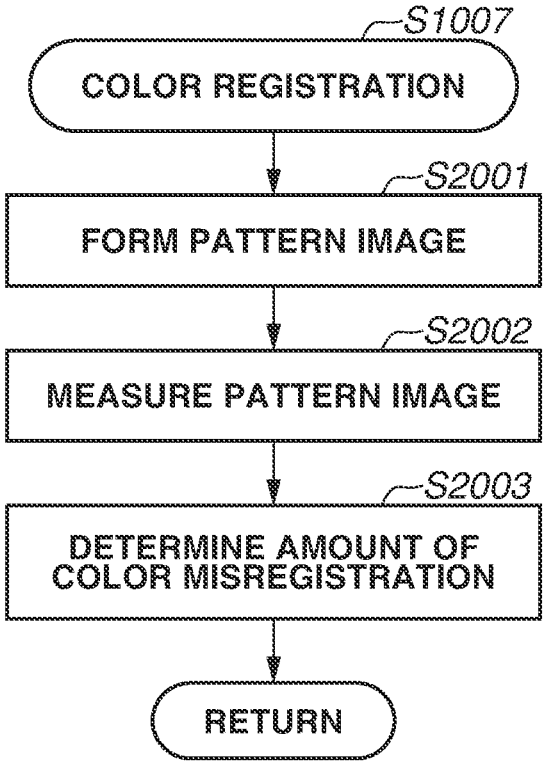
FIG. 11 is a flowchart illustrating color registration.

The color registration to be performed by the CPU 201 will be described below with reference to FIG. 11. The color registration is performed when an ambient temperature of the image forming apparatus 10 changes by a predetermined value or more, when the number of images formed by the image forming apparatus 10 becomes a predetermined number or more, and when a process is in step S1007 of the above described printing position adjustment control (FIG. 10). The CPU 201 reads out the control program stored in the ROM 202, to perform the color registration.

In step S2001, when the color registration is performed, the CPU 201 controls the printer engine 150 to form a pattern image (FIG. 3) on the intermediate transfer belt 104. In step S2002, the CPU 201 causes the sensor 109 to detect a timing that the pattern image passes through a measurement position. In step S2003, the CPU 201 determines a deviation (amount of the color misregistration) of the formation position of the image formed by the image forming station 101.

In step S2003, the CPU 201 causes the amount of the calculation unit 214 to calculate the deviation amount of the formation position of each pattern image based on the above described equations 1 and 2 from the measurement result of the sensor 109. The amount of the calculation unit 214 sets a correction amount for the color registration adjustment unit 212 based on the amount of the color misregistration to correct a timing that the laser beam irradiated from the exposure device 103 starts to be exposed. Thus, the formation positions of the images formed on the photosensitive drums 102*y*, 102*m*, 102*c*, and 102*k* are corrected. The correction amount for correcting the timing that the laser beam irradiated from the exposure device 103 starts to be exposed corresponds to a first correction condition for correcting the formation position of the black image serving as a second color vis-a-vis the magenta image serving as a first color.

Figure 12:
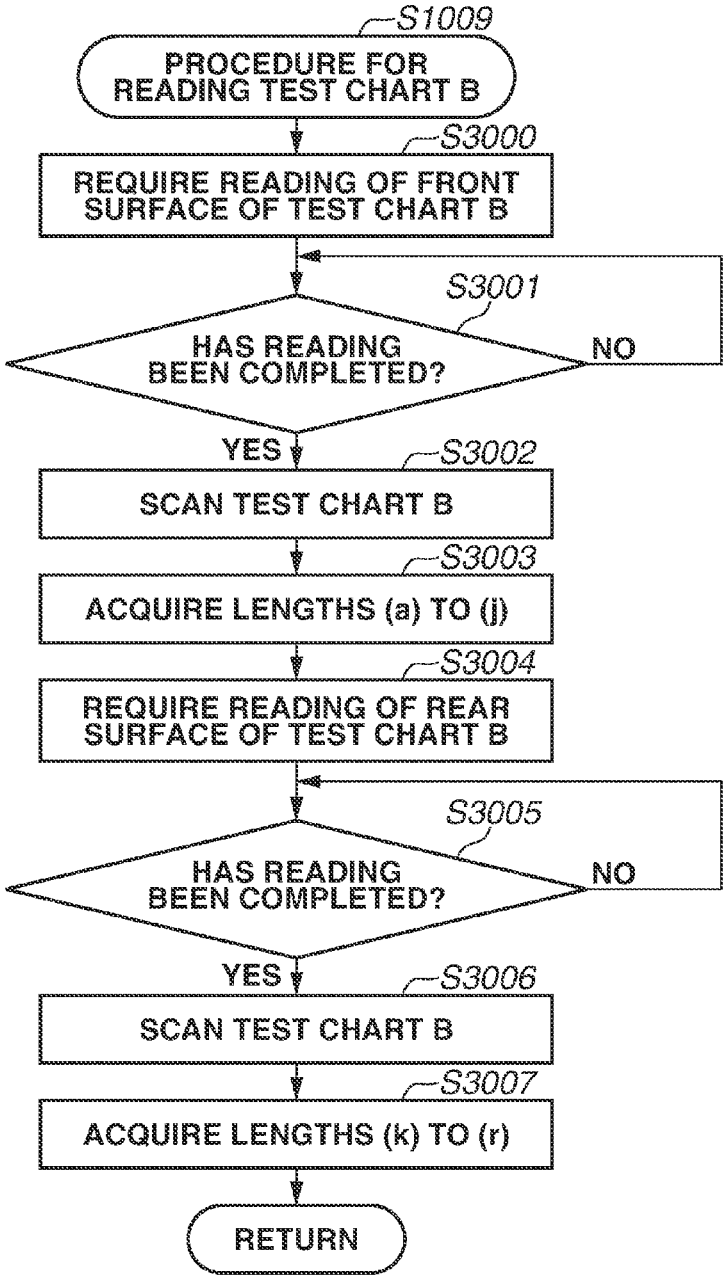
FIG. 12 is a flowchart illustrating processing for reading the test chart B.

The processing for reading the test chart B illustrated in step S1009 in the printing position adjustment control will be described below with reference to FIG. 12. In step S3000, the CPU 201 requests the user to carry out the operation for reading the front surface 800 of the test chart B when the processing for reading the test chart B is started. In step S3000, the CPU 201 displays a message for urging the user to read the front surface 800 of the test chart B using the scanner 100, on the display portion in the operation unit 20, for example.

In step S3001, the CPU 201 stands by until the reading of the front surface 800 of the test chart B is completed. If the user places the test chart B on a pressure plate in the scanner 100 such that the front surface 800 of the test chart B is directed downward and presses a reading start button from the operation unit 20 (YES in step S3001), then in step S3002, the CPU 201 causes the scanner 100 to read the front surface 800 of the test chart B.

In step S3003, after reading the front surface 800 of the test chart B, the scanner 100 acquires the length from the edge of the sheet to the measuring image 820 on the front surface 800 of the test chart B from the read data of the test chart B.

In step S3004, the CPU 201 then requests the user to carry out the operation for reading the rear surface 801 of the test chart B. In step S3004, the CPU 201 displays a message for urging the user to read the rear surface 801 of the test chart B using the scanner 100, on the display portion in the operation unit 20, for example.

In step S3005, the CPU 201 stands by until the reading of the rear surface 801 of the test chart B is completed. If the user places the test chart B on the pressure plate in the scanner 100 such that the rear surface 801 of the test chart B is directed downward and presses the reading start button from the operation unit 20 (YES in step S3005), in step S3006, the CPU 201 causes the scanner 100 to read the rear surface 801 of the test chart B.

In step S3007, after reading the rear surface 801 of the test chart B, the CPU 201 acquires the length from the edge of the sheet to the measuring image 820 on the rear surface 801 of the test chart B from the read data of the test chart B. The CPU 201 completes the processing for reading the test chart B, and the processing proceeds to step S1005 illustrated in FIG. 10.

Figure 14:
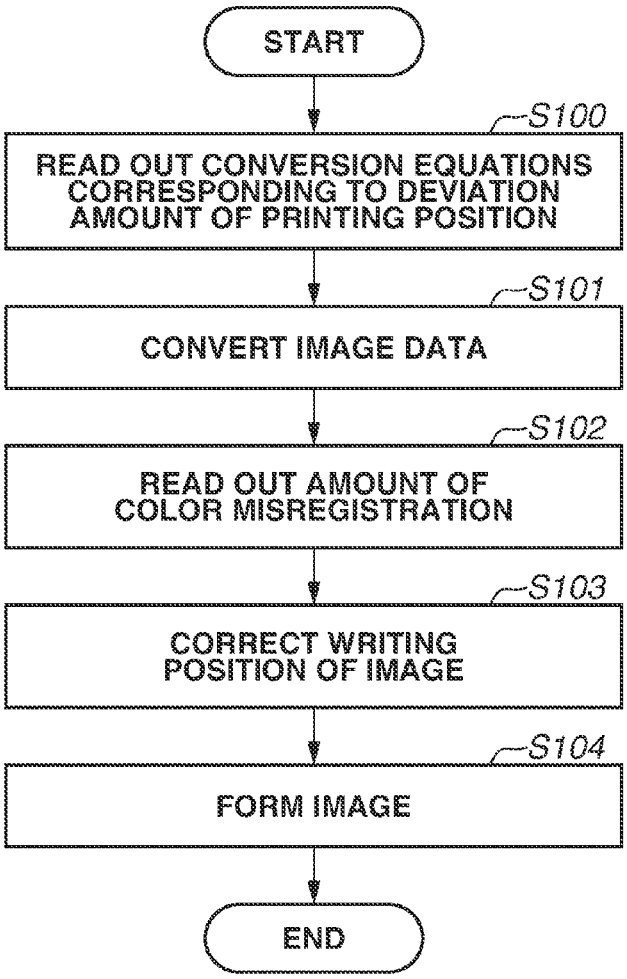
FIG. 14 is a flowchart illustrating an image forming operation.

An image forming operation performed when the image forming apparatus 10 prints the image on the document read by the scanner 100 and when the image forming apparatus 10 forms the image on the sheet based on the image data transferred from the PC (not illustrated) will be described with reference to a flowchart of FIG. 14.

In step S100, when the image data transferred from the scanner 100 or the PC is input, the CPU 201 reads out the conversion equations 1 to 5 for the front surface corresponding to the deviation amount of the printing position with respect to the sheet on which the image is formed from among the setting information stored in the sheet management table 400. In step S101, the CPU 201 causes the printing position correction unit 211 to convert the image data for the front surface based on the conversion equations 1 to 5 that have been read out in step S100.

In step S102, the CPU 201 then causes the color registration adjustment unit 212 to read out the amount of the color misregistration that has been determined by the amount of the calculation unit 214. In step S103, the CPU 201 corrects a timing of reading the image. In step S104, the CPU 201 controls the printer engine 150 to form the image on the front surface of the sheet based on the image data that has been output from the image processing unit 210.

If the two-sided printing mode has been selected, the CPU 201 controls a flapper to convey the sheet, which has passed through the fixing unit 107, to the reversing path 113. After the reversing path 113 has reversed the conveyance direction of the sheet, a conveyance roller (not illustrated) is driven to convey the sheet to the two-sided path 114. The sheet which has been conveyed along the two-sided path 114, is conveyed to the secondary transfer unit 106 after the conveyance speed and the conveyance timing of the sheet are controlled again in the registration roller 111.

When the image is formed on the rear surface of the sheet, the printing position correction unit 211 converts the image data for the rear surface based on the conversion equations 1 to 5 for the rear surface that have been read out of the sheet management table 400. The color registration adjustment unit 212 corrects the writing timing of the image based on the amount of the color misregistration that has been determined by the amount of the calculation unit 214. The CPU 201 controls the printer engine 150 to form the image on the rear surface of the sheet based on the image data that has been output from the image processing unit 210. The sheet having the images formed on both of its surfaces is output from the image forming apparatus 10 by the sheet discharge roller 112.

According to the present disclosure, the manual adjustment mode and the automatic adjustment mode can be set based on information selected by the user. The image forming apparatus 10 prints the test chart A having the measuring image 850 formed thereon when the manual adjustment mode has been selected and prints the test chart B having the measuring image 820 formed thereon in the automatic adjustment mode.

In the automatic adjustment mode for reading the test chart B using the scanner 100, the measuring image 820 on the test chart B is formed using the black toner to find the position of the measuring image 820 on the sheet with high accuracy. The image forming station 101*k* functions as a second image forming unit that forms the image using the black toner serving as the second color.

At this time, the color registration is performed before the test chart B is formed. Thus, even when the color registration is performed after the automatic adjustment mode is executed, the printing position of the image on the sheet can be inhibited from changing from the ideal printing position. Further, in the color registration, the sheets are not consumed. Therefore, the sheets can be inhibited from being excessively consumed by performing the printing position adjustment control many times.

On the other hand, in the manual adjustment mode in which the user manually inputs the measurement result of the test chart A, the measuring image 850 on the test chart A is formed using the magenta toner. Thus, the measuring image 850 is formed using the same image forming station 101*m* as the reference image in the color registration. Therefore, a down time from the start of the automatic adjustment mode to the formation of the test chart A can be suppressed. The image forming station 101*m* functions as the first image forming unit that forms the image using the magenta toner serving as the first color.

According to the present disclosure, the test charts A and B most appropriate for the adjustment method selected by the user can be printed, and the excessive consumption of the sheets and the downtime can be suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2015-160556, filed Aug. 17, 2015, which is hereby incorporated by reference herein in its entirety.

What is claimed is:

1. An image forming apparatus that forms an image on a sheet, the apparatus comprising:

an image forming unit including a first image forming unit configured to form a first image in a chromatic color and a second image forming unit configured to form a second image in black;

an intermediate transfer member onto which the first image and the second image are transferred;

a sensor configured to measure a measuring image formed on the intermediate transfer member, the measuring image being used for detecting color misregistration;

a determination unit configured to control the image forming unit to form a plurality of measuring images, each having a different color, and control the sensor to measure the plurality of measuring images;

a first adjustment unit configured to adjust an image forming position of the second image forming unit based on the color misregistration;

a second adjustment unit configured to adjust an image forming position of the image forming unit based on an adjustment condition;

an input unit configured to input a user instruction relating to a measurement value of a test image; and a generation unit configured to generate the adjustment condition, wherein the generation unit executes a first generation process for generating the adjustment condition based on the user instruction input from the input unit and executes a second generation process for generating the adjustment condition based on reading data output from a reading device, wherein, in the first generation process, the generation unit controls the image forming unit to form a first test image, having the chromatic color, on a sheet, acquires the user instruction relating to the measurement value of the first test image input from the input unit, and generates the adjustment condition based on the user instruction relating to the measurement value of the first test image, and wherein, in the second generation process, the generation unit controls the image forming unit to form a second test image, having the black color, on a sheet, acquires reading data relating to the second test image output from the reading device, and generates the adjustment condition based on the reading data relating to the second test image.

2. The image forming apparatus according to claim 1, wherein the second adjustment unit adjusts a shape of an image formation area to have a rectangular shape based on the adjustment condition.

3. The image forming apparatus according to claim 1, further comprising a conversion unit configured to convert image data, wherein the image forming unit forms the image based on the converted image data, and the adjustment condition corresponds to a conversion condition for converting the image data.

4. The image forming apparatus according to claim 1, wherein the first test image includes an arrow image, and a shape of the second test image differs from a shape of the first test image.

5. The image forming apparatus according to claim 1, wherein the generation unit controls the image forming unit to form the first test image and a guidance image.

6. The image forming apparatus according to claim 1, wherein the user instruction includes information related to a plurality of measurement values of the first test image.

7. The image forming apparatus according to claim 1, wherein the sensor includes an optical sensor that receives irregular reflection light from the measuring image.

8. The image forming apparatus according to claim 1, wherein the image forming position corresponds to an area in the sheet onto which the image forming apparatus forms the image.

* * * * *